US005078080A

United States Patent [19]

Schiele

[11] Patent Number: 5,078,080

[45] Date of Patent: Jan. 7, 1992

[54] CONTINUOUS VACUUM COATING APPARATUS

[76] Inventor: Josef Schiele, Brohltalstrasse 153, 5476 Niederzissen, Fed. Rep. of Germany

[21] Appl. No.: 594,128

[22] Filed: Oct. 9, 1990

[30] Foreign Application Priority Data

Oct. 6, 1989 [DE] Fed. Rep. of Germany ..... 3933405

[51] Int. Cl.[5] ..... B27K 5/02; B27K 3/02

[52] U.S. Cl. ..... 118/50; 118/602; 118/603; 118/610

[58] Field of Search ..... 118/50, 602, 603, 610

[56] References Cited

U.S. PATENT DOCUMENTS 3,745,971 7/1973 Story ..... 118/50

4,823,728 4/1989 Sturdivant ..... 118/50

FOREIGN PATENT DOCUMENTS 3740201 6/1989 Fed. Rep. of Germany .

*Primary Examiner*—Richard Bueker

*Attorney, Agent, or Firm*—Herbert Dubno

[57] ABSTRACT

A vacuum-coating apparatus has the vacuum-coating chamber mounted on an upright housing part of the upper end of which the suction generator is provided and whose lower end communicates with a horizontal housing part containing the coating-liquid supply. The liquid circulator includes a cartridge filter for removing solids from the liquid which is fed to the coating chamber and which has a conical easily-replaceable filter unit. The air from the changer is directed downwardly along an adjustable air-control plate on the underside of an air-guide plate and then upwardly around an edge of the air-control plate.

6 Claims, 2 Drawing Sheets

CONTINUOUS VACUUM COATING APPARATUS

FIELD OF THE INVENTION

My present invention relates to a continuous vacuum coating apparatus for the all-sided coating of articles with liquid-coating agents, for example, protective coatings or for specialty finishes or for surface embellishments generally.

BACKGROUND OF THE INVENTION

It is known to carry out an all-sided coating of workpiece articles, such as structural shapes, with corrosion-resistant or protective coatings, with lacquers or paints to improve surface quality or with other liquid-coating agents designed to constitute a specialty treatment for the articles in a continuous vacuum coating apparatus having a generally L-shaped housing with a lower horizontal relatively short housing part and an upright relatively long housing part.

In the lower horizontal and relatively short housing part, forming the short leg of the L, a medium supply is provided together with means for displacing, circulating and cleaning the flowable coating media.

The upper end of the upright or long leg of the L is provided with a vacuum generator which applies suction at a lateral opening of the upright portion of the housing which is connected to a vacuum-coating chamber.

An air-guide plate in the upright portion of the housing extends from the location above this opening at an inclination downwardly to ensure that air drawn out of the vacuum-coating chamber is directed downwardly along the guide plate before being permitted to rise in the upright leg of the housing to be discharged by the vacuum generators.

An apparatus of this type is disclosed, for example, in the German patent document DE-OS 37 40 201. This apparatus combines a number of advantages. For example, it can be rapidly set for workpieces of different sizes and shapes. It also permits vacuum-coating application to fields in which earlier vacuum-coating apparatus was not applicable.

The separation of particulates and residues from the evacuated air also was especially advantageous in this system by comparison with earlier arrangements wherein, for example, the vacuum-application chamber was provided directly above the liquid-supply vessel and seated thereon and wherein the vacuum generator was connected to one end of the latter vessel In these arrangements, the evacuated air stream from the vacuum-coating chamber, rich in finely dispersed atomized excess liquid was fed back to the supply vessel. However, since the evacuated air stream also passed along the free upper surface of the liquid in the vessel, liquid droplets could be entrained and hence the loading of the evacuated air stream with liquid could be increased.

The excess loading of the evacuated air stream with liquid substantially increased the cost of air cleaning as well as the losses of the liquid from the system.

In the improved arrangement with its L shape, however, the vacuum-coating chamber is disposed laterally on the upright leg of the housing. The vacuum generators provided at the upper end of this housing part are located very far from the supply of liquid, so that an intensive suction-air stream is not generated above the liquid surface.

The air-guide plate extending over the connecting opening between the upright leg of the housing and the vacuum-coating chamber does indeed deflect the suction-air stream downwardly before it can pass upwardly in the upright portion of the housing, but in the area in which this deflection takes place, there is little tendency to entrain liquid from the supply and any contact between the deflected air and the liquid is minimal.

The deflection does cause the air to rise opposite the inertia of the droplet particles and the gravitational force applied thereto so that the evacuated air is, to a large measure, cleaned of liquid before and as the air passes upwardly through the upright housing part.

Nevertheless, it is found in such systems that the air as it approaches the vacuum generators remains wet with the liquid components.

Directly upstream of the vacuum-generator units, moreover, it is customary to provide a filter for trapping any droplets before the air reaches the vacuum pump or pumps. In the earlier system, this filter is rapidly wetted with the liquid and thus operates as a wet filter. As a consequence, the discharged air or waste air practically always contains residues of the liquid.

This fact can be associated with needless expense since the residues in the waste air can withdraw substantial amounts of liquid from the liquid circulation path.

In apparatus of this kind, moreover, the short leg of the housing can be formed with an inclined bottom for the liquid supply. This inclined body can have at its lowest point a recess or clapper bottom at which the liquid-coating material is withdrawn by a feed pump and which is covered by a fine sieve at its top. A partial stream of controllable strength is branched from the liquid circulation path and is used to flush the fine screen from solid residues and to maintain flow through this screen.

It will be appreciated that workpieces can never be entirely free from dust and machining residues and that the liquid and especially excess quantities thereof, often entrain microfine solid particles with them. This can give rise to increasing operation times and increasing consumption of the liquid over which there may be a significant rise in the presence of such solid particles. This type of enrichment can plug narrow nozzles and detrimentally affect the surface qualities which are obtained, especially in lacquer applications.

It has been proposed to include cartridge filters in the liquid circulation path. Such cartridge filters have filtering units which are traversed inwardly by the liquid, i.e. from the exterior to the interior Replacement of the filter units and cleaning of the filter vessel from solids must be carried out relatively frequently and often is a problem.

There is little advantage to use filter units which have a more coarse porosity to increase the intervals between change because, in that case, the finest solid particles tend to be circulated in the system and may reach the workpiece surfaces to be detrimental to the coating or may provide an increased load in the waste air which must be removed by waste-air cleaning operations.

OBJECTS OF THE INVENTION

It is, therefore, the principal object of the present invention to provide an apparatus of the aforedescribed type which reduces the loading of the waste air and thus permits more economical waste-air cleaning if additional cleaning is required.

Another object of the invention is to provide an apparatus for the vacuum coating of articles in a continuous manner, which reduces the loading of the evacuated air with particles of the coating liquid and with particles of solids which may be circulated in such liquids.

Still another object of the invention is to provide an improved apparatus wherein the circulation of solid particles in the liquid is minimized.

Still another object of this invention is to provide a system in which drawbacks of prior-art arrangements are avoided.

SUMMARY OF THE INVENTION

These objects are attained, in accordance with the invention, in an apparatus for the purposes described and of the generally L-shaped construction previously set forth wherein, on the underside of the air-guide plate, a vertical planar air-control plate extends downwardly parallel to the vertical housing wall of the upright long leg and has a lower edge extending beyond the upper edge of the horizontal short leg of the housing downwardly and in the interior of the latter.

The air-guide plate is constructed and arranged to terminate substantially at the center of the width of the upright housing and adjoins or is proximal to a perforated or foraminous plate such that the two plates can overlap one another and the perforated plate can extend substantially to the opposite housing wall.

In the upper regions of the upright long leg of the housing, spaced apart from one another, are two further foraminous or perforated plates which extend over the full cross section of this portion of the housing and receive between them a replaceable filter mat which preferably lies loosely between these plates.

According to a feature of the invention, the feed or displacement device for the liquid medium is a circulating or feed pump which is connected to a cartridge filter disposed externally of the housing and receiving a conical filter unit and which can have a cylindrical vessel receiving at least part of that conical filter unit.

The feed line coming from the pump can open into the wide end of the conical filter unit while the clean-liquid return is connected to the bottom of the cylindrical vessel or receptacle for this filter unit.

The apparatus of the invention for a multiplicity of reasons ensures an improved removal of liquid and solids from the evacuated-air stream within the housing or prevents the entrainment of liquid and solids with the air stream so that any air cleaning required downstream of the apparatus can be reduced or eliminated.

In practice, the system of the invention provides successive flow cross sections of different sizes over the path of the evacuated air instead of a uniform flow cross section in which the same volume rate of flow or volume of flow per unit time is generated. In this system of the invention, therefore, in the regions of small flow cross section, the velocity of the air stream is high, white in regions of larger flow cross section, the flow velocity is correspondingly reduced. This variation in flow velocities increases the efficiency with which liquid and solids are separated from the evacuated air stream.

The air-control plate of the invention with its vertical orientation and lower edge reaching into the horizontal leg of the housing defines a downwardly directed flow passage of relatively small flow cross section in which the evacuated air from the vacuum-coating chamber is subjected to high acceleration and thus to a high flow velocity downwardly.

Liquid droplets and solid particles are correspondingly entrained downwardly with a high momentum and energy. This downward movement is supported by the gravitational effects on the liquid and solid particles.

At the lower edge of this air-control plate, there is a 180° deflection or direction change of the air stream at high velocities with a flow upwardly through a triangular cross section space with an inconstant cross-sectional enlargement, this space being delimited upwardly by the foraminous plate and the inclined air-guide plate. The direction change allows momentum separation of droplets and particles from the air and the velocity reduction allows sedimentation of particles from slowing the air stream.

Passage of the air stream around the lower edge ensures the formation of vortices in the triangular space. This turbulence also assists in reducing the entrainment of liquids and solids upwardly.

By comparison with the liquid droplets and the solid particles, the air, with its significantly lower specific gravity, is subjected to these direction changes in a substantially inertia-free manner. Liquid and solids collect by inertia on the surfaces against which they impinge and collect in the lower part of the housing. The rising gas passing, through the foraminous plate, is substantially free from liquid and solid particles.

Liquid droplets and solid particles, as a result of their higher specific gravity, are not diverted as readily as the air stream and flow based upon their inertia or momentum and the action of gravity, directly downwardly to collect in the liquid supply vessel. At this point, therefore, there is already a highly effective separation.

Naturally, not all foreign particles and liquid residues can be sedimented out in this manner. Many particles settle out first in the very slow vortex or turbulent flow as a result of a centrifugal action in which these particles are cast against surfaces bounding the triangular space and pass downwardly Liquid foam flocs, which also are produced, remain however in entrainment with the air and are drawn upwardly therewith by the suction blowers at the top of the upright leg of the housing. Most of these liquid-foam flocs thus encounter the perforated plate or sieve plate and deposit thereon in an impingement action which breaks down the foam since the plate constitutes a baffle or irregularity for the air stream. As a consequence of this impingement baffling effect, further quantities of contaminant are separated from the air stream.

Above the perforated plate, the upright leg of the housing has a comparatively wide cross section without irregularities and, as a result of the velocity reduction, even with a laminar flow in this region, any contaminants which may still be entrained by the evacuated air stream, can settle out. The perforated plate or sieve plate appears to confine the turbulence to the triangular region below this plate.

As a consequence, the residual liquid particles tend to settle from the slowly upwardly moving suction air stream by gravity as the suction air stream is calmed. In this region, the velocity of the air stream may be reduced to a point that further entrainment of droplets and solid particles is not possible.

At the uppermost part of the upright housing leg, the air passes through the above-mentioned filter mat which can remove even microfine or colloidally-suspended solid particles which may remain in the air stream. I have found, quite surprisingly, that this filter mat remains dry. Apparently there is substantially no fluid entrainment by the air onto the filter mat at the upper end of the upright housing leg.

Consequently, when coating media containing water soluble water pigments or the like are used in the apparatus of the invention, the air cleaning is practically complete in the apparatus itself and downstream cleaning may not be necessary at all. A precondition for this type of operation is that the liquid medium during operation be free or substantially free from the finest solid particles which in the past always were a major contaminant of the liquid. This is achieved, in accordance with the present invention, by the cartridge filter previously described.

Because the conical filter unit, having its large diameter opening turned upwardly, is traversed by the liquid from top to bottom, the solid filter residues are trapped within the filter unit and can be removed with the latter when the cartridge filter is changed using conventional quick-acting fastening means for attaching the filter unit and/or filter housing movable parts to the stationary parts of the housing.

These quick-release connectors should have easy access to the apparatus and hence the filter is preferably disposed on the exterior of the housing. Special cleaning operations are avoided.

According to a feature of the invention, the air-control plate is displaceable in guide rails via a positioning spindle or screw operable from the exterior and in the longitudinal direction of the air-guide plate to vary the distance of the air-control pate from the housing wall carrying the vacuum-coating chamber.

Through the use of such means for varying the distance of the air-control plate from this wall, optimum results with respect to the separation operation can be obtained because the apparatus can be set optimally for differences in the liquid, differences which result from changes in the size or form of the workpiece or in the manner in which it is treated, differences in the way the workpieces are passed through the coating chamber, i.e. whether this is an end-to-end displacement or a continuous movement of some other kind of a movement which allows even the end faces to be coated, variations in suction and vacuum or flow, and differences in the liquid separation or cleaning conditions which may be desirable. The adjustment of the desired separation effect and as to the coating can be made by hand or by means of conventional sensors, servomechanisms or the like for automatic adjustment.

According to still another feature of the invention, the liquid feed of the cartridge filter is from above and along the axis of the filter-unit cone, while the apex angle of the cone of the filter unit is selected with respect to the liquid input pressure and vacuum pressure and the flow resistance of the filter unit so that over the total length of the filter unit, the flow velocity of the liquid remains approximately constant.

This condition has been found to be important to efficient liquid cleaning since it allows the conically-configured filter unit to be fully utilized before it must be replaced. When the full length of the filter unit has a constant flow velocity, then the filter surfaces uniformly collect any residues and the filter unit can be fully utilized.

According to another feature of the invention, the liquid supply can be provided at the upper wide end of the conical unit which may, if desired, also have a cylindrical solids-collecting chamber or compartment at its lower end. A tangential flow can be provided at the open end of the filter unit so as to induce a cyclonic motion of the liquid. These features have been found to further increase the duration over which the filter may be useful since the cyclone effect assists in separation of solids while washing down collected solids to the cylindrical chamber at the bottom, thereby permitting greater accumulation of solids in the filter unit. Closable service openings, provided with appropriate flaps capable of hermetically sealing against the upright housing part, can be provided in the region of the sieve plate and in the region of the filter mat to allow cleaning and replacement of these regions.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
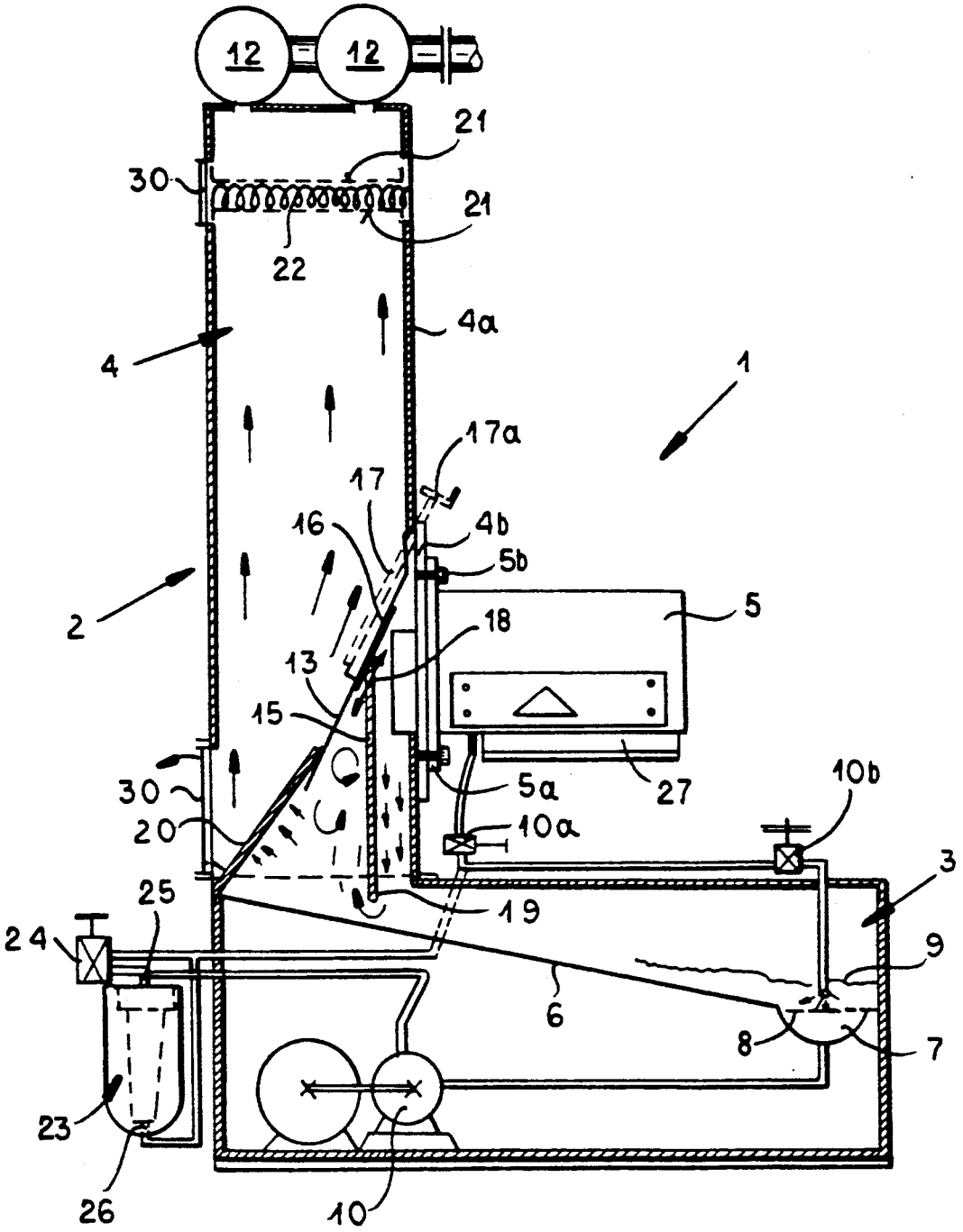
FIG. 1 is a schematic vertical section through an L-shaped apparatus according to the invention for the vacuum coating of objects.

FIG. 1 shows a continuous vacuum-coating apparatus 1 which has certain elements in common with the prior art as noted, and which will not be described in detail.

The apparatus 1 comprises an L-shaped housing 2 which is composed of a lower horizontal relatively short housing leg 3 and an upright relatively long housing leg 4.

The housing part 4 has along one lateral wall 4*a*, an opening 4*b* on to which a vacuum-coating chamber 5 is flanged at 5*a* by bolts represented at 5*b*. The chamber 5 can be replaceable and can be equipped for adjustment to the particular products to be coated with lacquer, paint or other liquid material by any conventional means not shown. The workpieces can pass contiguously or in end-to-end relationship through the chamber.

The horizontal housing part 3 has internally a floor 6 which is inclined downwardly away from the region below the upright housing part 4 and formed, at a lower point of this floor, with a depression 7 covered by a screen 8 and containing a liquid supply 9 which may be a lacquer.

A circulating and feed pump 10 draws the liquid lacquer or other impregnating, coloring, glazing or like liquid, from the supply 9 and feeds the liquid to the coating chamber 5 via appropriate valves 10*a*, 10*b*, etc. The circulating means includes cartridge filters 23 which will be described in further detail subsequently.

Via the valves 10*a* and 10*b*, a portion of the liquid can be contiguously fed through the screen 8 to rinse the latter free from solid residues.

The coating chamber 5 requires a forced evacuation. For that purpose, at the upper end of the upright housing part 4, vacuum generators or blowers 12 of appropriate suction force are provided to generate the "vacuum."

The outlet opening from the coating chamber 5 coincides with the opening 4*b* previously mentioned In the housing part 4, from a location above this opening and extending downwardly and inwardly, there is provided an air-guide plate 13 which can intercept the inflowing suction air flow and direct that flow downwardly. This air-guide plate 13 covers the opening 4*b* from above.

On the underside of the air-guide plate 13 is a downwardly extending air-control plate 15 which extends parallel to the housing wall 4*a* but is spaced therefrom. Via guide rails 16 and a threaded spindle 17 controlled by a hand wheel 17*a* a plate 15 can be moved in the direction of the double-headed arrow 18 but varying its distance from the housing wall 4*a*.

At its lower edge 19, the air-control plate 15 extends close to the floor 6 and serves to provide a 180° deflection of the downwardly flowing suction air into an upward flow along the left-hand side of this plate 15.

The air-guide plate 13 extends over substantially only half the width of the cross section of the upright housing part 4. The balance of the flow cross section is bridged by a perforated plate 20, also referred to herein as a sieve plate.

Because the flow cross section defined between the wall 4*a* and the air-control plate 15 can be reduced by the spindle 17, a high acceleration and velocity of the suction air flow downwardly from the opening 4*b* and the vacuum chamber 5 is induced, whereupon the high velocity air flow receives a sharp deflection through about 180° around the lower edge 17 into the triangular region demarcated between plates 13 and 20 on the one hand and the plate 15 on the other. The increased flow cross section in this region reduces velocity and the triangular configuration ensures a significant turbulence. The combination of change of direction and change in the manner of flow results in a precipitation from the suction air flow of liquid droplets and solid particles which flush downwardly along the floor 6 toward the depression 7.

Liquid foam floc and other liquid droplets impinge upon the sieve plate 20 and are removed from the suction air flow by impingement-baffle separation.

The sieve plate 20 generates above itself, a quiescent or laminar air flow which, as a consequence of the substantial increase in flow cross section, rises very slowly in the housing part 4 above the suction 20 and the plate 13 Any residual liquid droplets sediment by gravity from the rising air stream.

The upper end of the housing part 4, upstream of the suction-generating means 12 is provided with a pair of large perforated plates 21 extending the full cross section of the housing part 4 and receiving between them a loose and readily replaceable filter mat 22. Surprisingly, this filter mat remains dry even with extended periods of operation of the apparatus because of the excellent liquid separation upstream thereof.

Substantially clean discharged air and high quality surfaces of the workpieces treated can only result when solid particles are removed efficiently from the liquid circulation. These solid particles may result from contaminants washed from the workpiece surfaces and solids like dried pigments formed by the process.

To this end, the cartridge filter 23 is connected to the pump 10 of the liquid-circulating means.

A bypass valve 24 serves to allow continuous flow of the liquid even during filter replacement by bypassing the filter. I have found that it is possible to operate briefly utilizing this bypass and without a cartridge filter without detrimentally affecting the coating and without interruption of the operation of the apparatus.

The cartridge filter 23 has a liquid inlet 25 connecting from the displacement pump and a clean liquid outlet 26 at the lower end of the housing of the filter.

Advantageously, the cartridge filter 23 comprises a conical filter unit 27 whose wide opening is turned upwardly, and a generally cylindrical filter vessel enclosing this filter unit.

Figure 2:
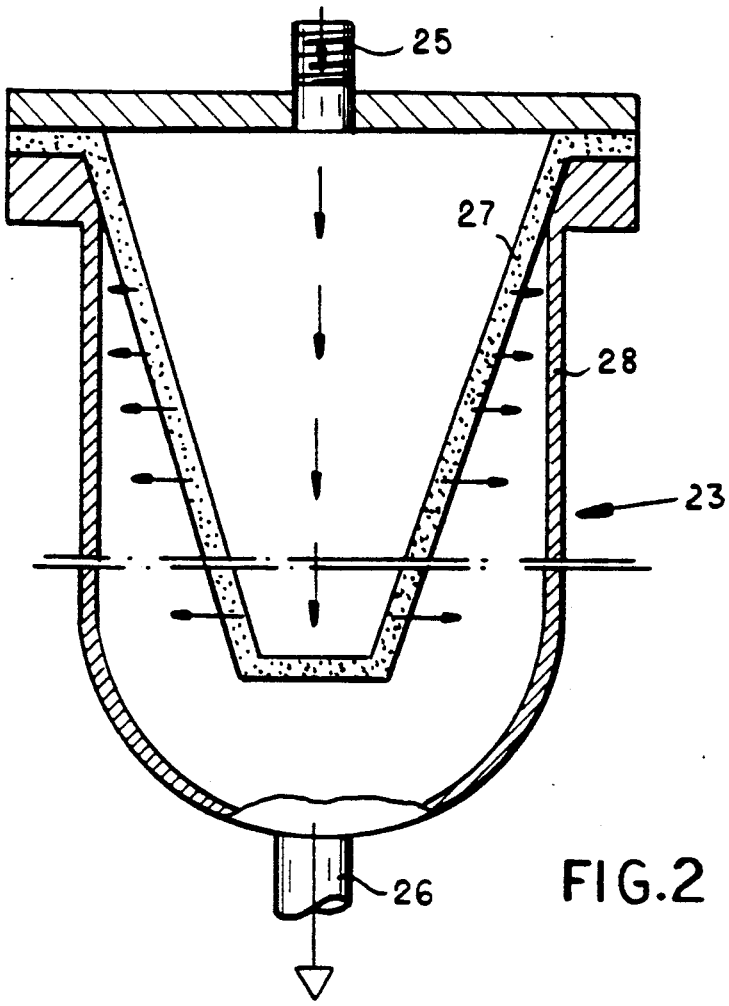
FIG. 2 is a diagrammatic elevational view of a cartridge filter according to the invention.

As will be apparent from FIG. 2, the cone angle of the filter unit 27 is so selected relative to the liquid pressure and volume that the liquid flow with coaxial supply through fitting 25 has a constant velocity over the entire length of the filter unit 27. The filter surface loading thus remains constant over all portions of the filter and filter utilization is maximized.

The replacement of the filter unit 27 is simple because the residues are created in the filter unit 27 itself so that they can be discharged with the filter unit. Cleaning operations for the filter vessel 28, especially upon the change in color, can be obviated.

Figure 3:
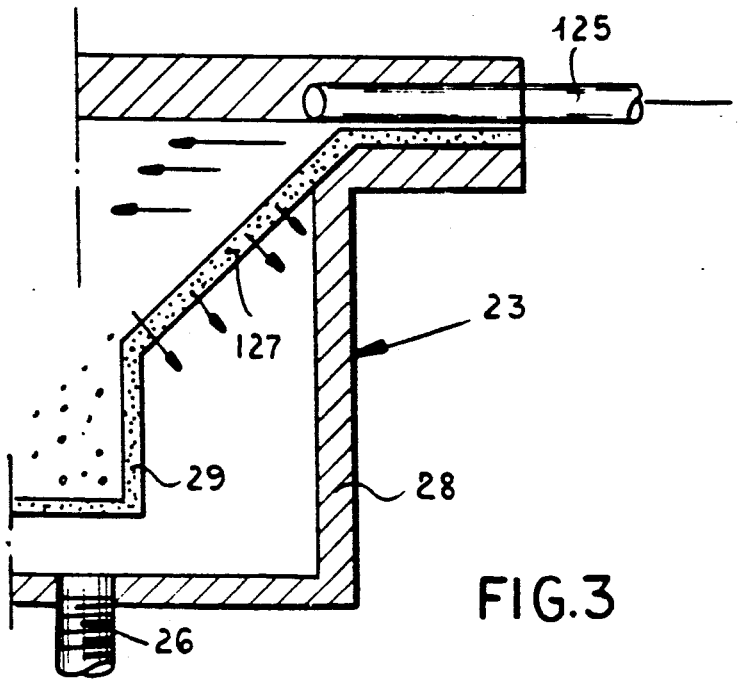
FIG. 3 is a view of a portion of another filter according to the invention shown fragmentarily.

In the embodiment of FIG. 3, the liquid supply 125 is tangential to the inner surface of the filter unit 127 so that a cyclonic action is provided which rinses the solids on the filter downwardly. The bottom of the filter can be formed with a solids-collection compartment 29 at this load end. When such a compartment is used, e.g. as a separate element or as part of the filter unit 127, in conjunction with a flushing action as described, the filter unit 127 can have a very long operating life.

To simplify maintenance and permit replacement of the entire filter unit, the housing part 4 in the region of the filter mat 22 and the sieve plate 20 can be provided with vacuum-tight closable access hatches or flaps 30.

It should be apparent that the invention encompasses not only the embodiments illustrated and described by way of example, but also any other configuration of the apparatus within the spirit and scope of the appended claims and consequently not only the individual features recited, but also their combinations.

I claim:

1. A vacuum coating apparatus, comprising:

a generally L-shaped housing having a relatively long upright leg and a relatively short horizontal leg connected to said upright leg at a lower end thereof, said upright leg having a lateral wall formed with an opening, said horizontal leg receiving a supply of a coating liquid;

suction-generating means connected to said upright leg at an upper end thereof for inducing a suction-air flow into said housing through said opening and drawing said suction-air flow upwardly through said upright leg;

a vacuum coating chamber connected to said wall and communicating with said housing through said opening for evacuation by said suction-generating means, said chamber being adapted to receive an article to be coated with said liquid whereby said suction-air flow induced into said housing through said opening contains droplets of said liquid and solid particles;

an air-guide plate inclined downwardly and inwardly from said wall in said upright leg from a location above said opening over approximately half of a width of said upright leg;

a planar air-control plate extending vertically downwardly from an underside of said air-guide plate in said upright leg, spaced from and generally parallel to said wall and reaching below an upper edge of said horizontal leg into said horizontal leg to terminate therein at a lower edge at which said suction-air flow is deflected through about 180°;

a foraminous plate extending downwardly from said air-guide plate across a remainder of the width of said upright leg to define with said air-guide plate a region of turbulence above said horizontal leg and into which said suction-air flow passes upon deflection around said lower edge;

a pair of perforate spaced-apart plates spanning a full width of said upright leg at an upper end thereof upstream of said suction-generating means and receiving between them loosely a filter mat removing particulates from said suction-air flow; and liquid-circulation means including a cartridge filter disposed externally on said housing and a pump connected to said supply for feeding said liquid to said chamber, said cartridge filter including:

a generally cylindrical vessel having an upright axis, a generally conical filter unit in said vessel having a wide upper end and a narrow lower end, means for feeding an inflow of liquid from said pump into said upper end, and means for discharging liquid from said vessel at a lower end thereof.

2. The apparatus defined in claim 1, further comprising guide rails disposed along said air-guide plate and slidably receiving said air-control plate, and a positioning spindle operable externally of said housing for shifting said air-control plate along said rails and adjusting a distance of said air-control plate from said wall.

3. The apparatus defined in claim 1 wherein said liquid-circulation means includes means for introducing said liquid from said pump axially into said upper end of said filter unit, said filter unit having a conicity selected with respect to the flow resistance of the filter unit and a pressure of said liquid such that a substantially constant flow velocity of said liquid is maintained through said filter unit over the entire length thereof.

4. The apparatus defined in claim 1 wherein said liquid-circulation means includes means for directing the liquid from said pump generally tangentially into said upper end of said filter unit

5. The apparatus defined in claim 1, further comprising a generally cylindrical solids-collection compartment formed at a lower end of said filter unit.

6. The apparatus defined in claim 1, further comprising air-tight flaps closing servicing openings formed on said upright leg and affording access to said mat and to said foraminous plate.

* * * * *